United States Patent [19]

Gerry

[11] Patent Number: 4,554,486

[45] Date of Patent: Nov. 19, 1985

[54] IGNITION TRANSFORMER WITH PASSIVE VOLTAGE AND CURRENT MULTIPLYING MEANS

[76] Inventor: Martin E. Gerry, 13452 Winthrope St., Santa Ana, Calif. 92705

[21] Appl. No.: 663,329

[22] Filed: Oct. 18, 1984

[51] Int. Cl.[4] ..... H05B 37/02; H05B 39/04; H05B 41/36

[52] U.S. Cl. ..... 315/209 R; 333/24 C; 333/140; 315/85; 315/209 T; 315/224

[58] Field of Search ..... 315/209 R, 209 T, 209 CD, 315/85, 224; 333/140, 24 C, 23, 138, 140

[56] References Cited

U.S. PATENT DOCUMENTS

| | | | |
|---|---|---|---|
| 1,972,319 | 9/1934 | Rypinski | 333/140 X |
| 2,189,899 | 2/1940 | Hartzell | 315/85 X |
| 2,378,893 | 6/1945 | Berkey et al. | 315/85 X |
| 4,261,025 | 4/1981 | Chafer et al. | 315/209 CD |
| 4,317,068 | 2/1982 | Ward et al. | 315/209 T |
| 4,422,054 | 12/1983 | Gerry | 315/209 R |
| 4,451,764 | 5/1984 | Gerry | 315/85 |

*Primary Examiner*—Saxfield Chatmon

[57] ABSTRACT

A transformer (T) with a primary winding (L1) and a secondary winding (L) coupled to the primary winding. A capacitive element (C) is coupled to the secondary winding for providing an increased output voltage level and an increased output current level from the transformer. The capacitive element may be either of distributed or lumped parameter structure. A reduction in the number of secondary winding turns may be compensated for with the capacitive element to maintain the same voltage output level as was obtained prior to reduction in secondary winding turns and also to obtain an increased current output level by virtue of the presence of the capacitive element and/or the reduction in the number of secondary winding turns. Such reduction in secondary winding turns reduces the physical size of the transformer as well as reducing its copper losses, and also reduces its cost of fabrication.

27 Claims, 19 Drawing Figures

IGNITION TRANSFORMER WITH PASSIVE VOLTAGE AND CURRENT MULTIPLYING MEANS

TECHNICAL FIELD

This invention is in the field of transformers as utilized in ignition systems for fuel burning engines.

BACKGROUND ART

U.S. Pat. No. 4,422,054 issued Dec. 20, 1983 to same applicant, employs an inductive-capacitive element shunting the secondary winding of the ignition transformer. Although making reference to increased energy output from such transformer, this patent does not disclose voltage and current multiplication by virtue of this shunt.

U.S. Pat. No. 4,451,764 issued May 29, 1984 to same applicant, illustrates a capacitive element shunt across the secondary winding of the ignition transformer. This patent discloses the secondary winding voltage at the time of igniter firing and does not disclose the secondary winding voltage prior to igniter firing. Such patent discloses a rise in secondary winding voltage with increased values of capacitive elements rather than decreases in such secondary voltages with increased capacitive. The patent shows that the igniter current is relatively constant with changes in value of capacitive element rather than an increase in such current with increased capacitive element value.

DISCLOSURE OF INVENTION

It is an objective of this invention to increase the secondary winding voltage of an ignition transformer without increasing the turns ratio thereof.

It is another objective of this invention to increase the igniter firing current output of such transformer without increasing the magnetizing flux of the ignition transformer's magnetic core.

It is still another objective of this invention to reduce the number of turns of the secondary winding of the ignition transformer but maintain an effective turns ratio which will provide the same secondary voltage as was obtained with the actual number of turns of secondary winding before reduction in such actual number of turns.

It is yet another objective of this invention to reduce the actual turns ratio of the ignition transformer yet maintain an effective turns ratio that will provide the same secondary voltage as was obtained prior to reduction of such actual turns ratio, and at the same time increase the firing current provided by such transformer to an igniter.

Accordingly, either a lumped parameter or distributed parameter capacitive element is connected in parallel circuit with the secondary winding. An array of differently valued capacitive elements will provide different values of voltage and current outputs to feed the igniters. Such capacitive elements may also be connected between the high side of the secondary winding and ground, or between the high side of the secondary winding and the high side of the primary winding of such ignition transformer with substantially the same effect.

Inasmuch as the secondary voltage and current outputs are increased by utilization of differently valued capacitive elements, the secondary winding turns may be substantially reduced in quantity and still enable the maintenance of at least the same secondary winding voltage output as was obtained prior to reduction of such winding turns. With the reduced number of secondary winding turns, the secondary current would normally increase, and with the presence of the capacitive element such secondary winding current would even further increase to produce an extremely high energy source feeding the igniter.

BEST MODE FOR CARRYING OUT THE INVENTION

Structural and Functional Aspects of the Invention

Figure 1:
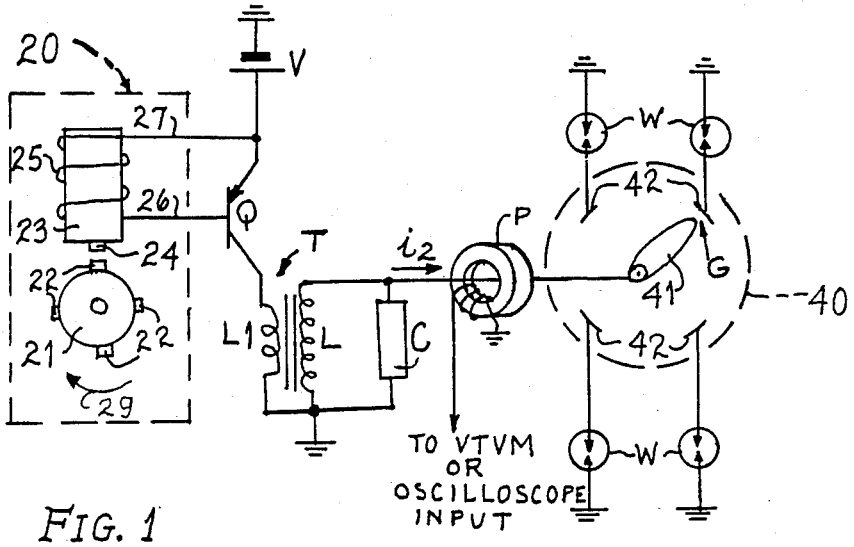
FIG. 1 is an electrical and electro-mechanical schematic illustrating an ignition circuit encompassing the invention. Such circuit is also utilized in illustrating the measurement of igniter firing current.

Referring to FIGS. 1 through *6a*, a utility of the invention is depicted by FIG. 1 ignition system for a fuel burning engine. Such system employs a magnetic pulse timer 20, and distributor 40 wherein a common distributor shaft drives both reluctor wheel 21 of timer 20 and high voltage distribution arm 41 of distributor 40 in a clockwise direction shown at 29, during operation of the ignition system. Ignition transformer T is controlled by timer 20, and the output of the transformer is connected to arm 41 by means of a distribution circuit.

Figure 2:
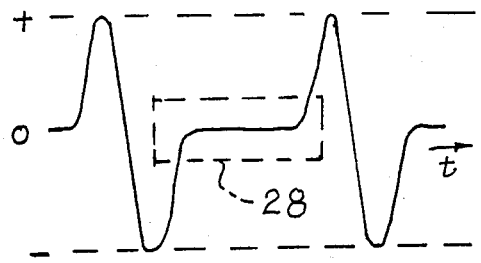
FIG. 2 is a graph showing the voltage output characteristics of a magnetic pulse timer feeding the electronic switch of the circuit of FIG. 1.

Timer 20 comprises reluctor wheel 21 which has protrusions 22 equally spaced at the periphery of wheel 21, so that when a protrusion 22 passes armature 24 of magnetic core 23, arm 41 passes one of stationary distributor members 42 to fire one of igniters W. Magnetic core 23 has a sensor winding 25 wound thereabout, and when protrusion 22 passes armature 24, a voltage depicted by FIG. 2 is produced across winding 25 between leads 26 and 27 thereof. FIG. 2 shows winding 25 providing a voltage the positive excursion thereof leading its negative excursion. Although such voltage output can be reversed by reversing the connection of leads 26 and 27 so that the negative excursion will lead the positive excursion, the waveform of FIG. 2 as illustrated is more desirable inasmuch as a greater period of time is allocated to charging primary winding L1 which occurs during the time period and within zone 28, permitting a shorter period of time for discharge during the positive waveform excursion. If an NPN type transistor switch would have been used instead of transistor Q, a PNP type, then a negatively leading waveform would have been desired.

When the negative excursion of FIG. 2 waveform is applied to lead 26, lead 27 is placed at a positive potential with respect to lead 26, and base current flows in switch Q starting collector current flow and applying a potential V of +12 volts D.C. to primary winding L1 of ignition transformer T, to charge L1 during charging period denoted by zone 28. When the positive portion of the waveform of FIG. 2 arrives at lead 26, lead 26 becomes more positive with respect to lead 27, discontinuing flow of base current and turning off switch Q. It is to be noted that transistor switch Q being a Darlington power type and therefore has an inherent capacitive output in the neighborhood of $0.2\times10^{-6}$ farads between its collector and emitter terminals, and shown below as C1 in the equivalent circuit of FIG. 7. When switch Q is turned off, L1 discharges through the capacitor to create an oscillatory voltage in L1, which normally is seen across secondary winding L multiplied by a factor representing the turns ratio of secondary to primary winding turns, typically being 98.

The performance of timer 20 may be illustrated by a truth table, as follows:

| Protrusion 22 | Base of Q Potential | Switch Q Condition | L1 State | Voltage Induced in L |
|---|---|---|---|---|
| in proximity of armature 24 | − | ON | charges | no |
| not in proximity of armature 24 | + | OFF | discharges | yes |

The voltage induced in secondary winding L is also present across capacitive element C in view of the parallel connection of C and L. The current flowing in the LC circuit will determine current level $i_2$ which is the igniter firing current through arm 41 and one of the stationary members 42 of distributor 40 and fed via gap G to igniter W. Means represented by pick up inductor P are provided to measure current $i_2$ by connecting either a vacuum table voltmeter or an oscilloscope to the sensing coil of inductor P, to be further discussed below.

Figure 3:
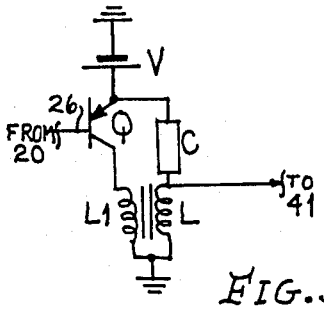
FIG. 3 is an electrical schematic illustrating one alternate method of connecting a capacitive element to the ignition transformer in the circuit of FIG. 1.
Figure 4:
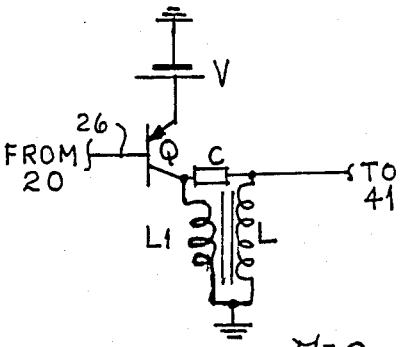
FIG. 4 is an electrical schematic illustrating another alternate method of connecting a capacitive element to the ignition transformer in the circuit of FIG. 1.

An alternate method of coupling capacitive element C is to connect such element either between the high side of secondry L and the positive terminal of power source V, or to connect such element between the high side of secondary L and the high side of primary L1, as respectivey shown in FIGS. 3 and 4.

Figure 5:
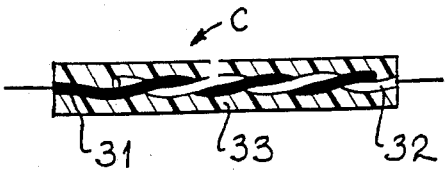
FIG. 5 is a cross section view, partially in elevation, of one form of distributed capacity element usable in the circuit of FIG. 1.
Figure 6:
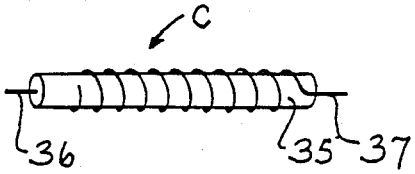
FIG. 6 is a perspective view of another form of a distributed capacity element usable in the circuit of FIG. 1.

With respect to capacitive element C, such element may be either of distributed parameter type as shown in either FIG. 5 or FIG. 6, or of the lumped parameter type shown in FIG. *6a*. FIG. 5 distributed capacity element is comprised of a pair of twisted or transposed insulated wires 31 and 32 which may be embedded in an insulating jacket 33 to prevent arc over at either of the two unconnected wire ends. Only one end of each wire, at opposite ends of the capacitive element, is used for connection to the circuit of FG. 1. FIG. 6 distributed capacity element is comprised of insulating material 35 in which wire 36 is embedded, only one end of such wire protruding from the insulation for electrical connection to the circuit of FIG. 1. A coil as at 37 is wound about insulation 35 and only one end of such coil is used to make connection to the circuit of FIG. 1. The use of distributed capacity elements over lumped parameter elements is preferred in view of the fact that the total secondary voltage is divided along the length of the distributed parameter capacitor subjecting only a unit portion of the capacitor to only a unit portion of the secondary voltage, whereas the lumped parameter capacitor is subjected to the total secondary winding voltage.

One method of utilizing lumped parameter capacitors and reducing the voltage stress is to use a series chain of capacitors to divide the voltage of the secondary winding among such capacitors. FIG. *6a* illustrates series chain $C_a$, $C_b$ . . . $C_m$=C, so that if for example C is desired to be 100 picofarads, such series chain may be constructed using 10 capacitors of 1000 picofarads each, rated at 6 kilovolts each. If the secondary voltage is 60 kilovolts, then each capacitor of the series chain will be subjected to only 6 kilovolts stress.

Theoretical Considerations and Computational Aspects of Invention

Prior to discussion of the drawings pertinent to the computations and theory, it is noted that the conventional ground symbol is utilized herein as an electrical return path for DC and AC voltages and currents. It is also noted that a capacitor C1 shown in FIG. 7 equivalent circuit constitutes the emitter-collector effective output capacity of switch Q, a type 2N6287 PNP Darlington transistor, and not being a discrete capacitor, it was not illustrated in the FIG. 1 circuit. Likewise, the self or inherent series resistances R1 and R of L1 and L respectively are not shown in FIG. 1 circuit but are illustrated in the FIG. 7 equivalent circuit since these parameters are required for computational purposes.

Figure 7:
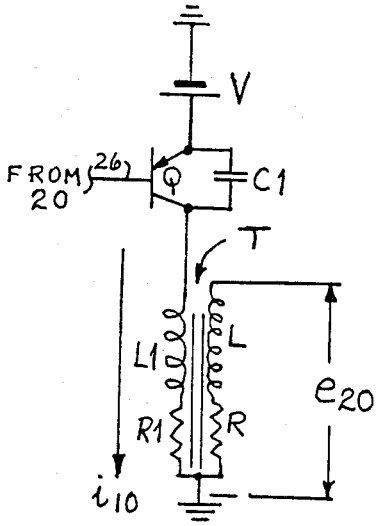
FIG. 7 is an equivalent circuit, based on the circuit of FIG. 1, used for calculating the charging current through the primary winding of the ignition transformer, and for calculating the open circuit secondary winding voltage of such transformer.
Figure 6A:
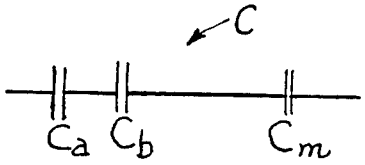
FIG. 6*a* is an electrical schematic of a series of capacitors utilized as a lumped parameter capacitive element.
Figure 8:
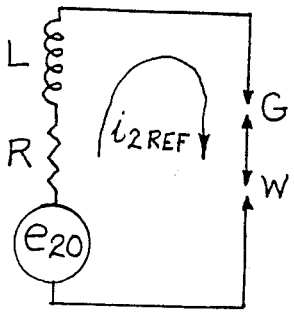
FIG. 8 is an equivalent circuit of the secondary winding of the ignition transformer with the open circuit voltage induced therein, for the purpose of calculating the igniter firing current when no capacitive element is present in the secondary winding circuit, such igniter firing current being used as a reference level to determine current levels with inclusion of capacitive elements.
Figure 9:
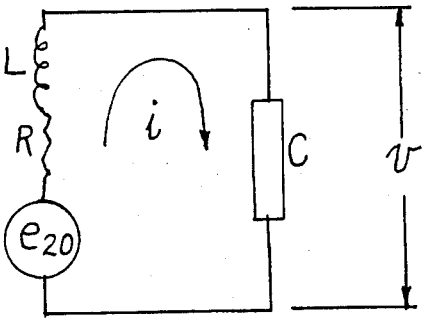
FIG. 9 is an equivalent circuit of the secondary winding of the ignition transformer with the open circuit voltage induced therein and including a capacitive element, for calculating the current through the capacitive element and for determining the voltage thereacross for different values of capacitive elements.

FIGS. 7, 8 and 9 represent the equivalent circuits for determining the open circuit secondary voltage $e_{20}$ across secondary winding L, the secondary winding reference current $i_{2REF}$ without any capacitive element C in such secondary circuit, and the secondary voltage v when capacitive element C is connected in parallel with winding L, as well as the other connections of C shown in FIG. 3 or FIG. 4. Measurements of igniter firing current $i_2$, as illustrated in FIG. 1, will make use of reference current $i_{2REF}$ as computed using FIG. 8 equivalent circuit to determine the firing current $i_2$ with different values of capacitive element C.

The mathematical treatment that follows involves solution of integro-differenctial equations based on models of FIGS. 7, 8 and 9 as well as determination of initial conditions and induced primary and secondary voltages in the igitiona transformer. These integro-differential equations are converted into Laplace transformed equations thereby converting from the time domain to the complex or frequency domain. The currents are solved using different values of capacitive elements C by inverse Laplace transformation, herein utilizing the Residue Theorem to evaluate the residues at the poles of the current function in the complex plane. The solutions being in the time domain, are graphed in FIGS. 10 through 17. From such graphed solutions, the peak secondary pre-firing voltage v and the igniter firing current $i_2$ are respectively graphed in FIGS. 18 and 19 as functions of capacitive C values.

These equivalent circuits use symbols, since symbols are more expedient in developing the various equations, as opposed to numerals, in the transient analyses that follow, yielding the performance characteristics depicted in FIGS. 10 through 17.

The symbolic parameters used are defined in the following tables, those having discrete values being stated in such tables.

TABLE 1

| Symbolic Parameter | Definition | Value |
|---|---|---|
| V | D.C. power source | 12 volts |
| Q | transistor switch | type 2N6287 |
| C1 | inherent output capacity of Q | $0.2 \times 10^{-6}$ farads |
| T | ignition transformer | turns ratio of 98:1 |
| L1 | primary winding of ignition transformer T | $6.7 \times 10^{-3}$ henries |
| R1 | inherent (self) series resistance of L1 | 1.4 ohms |
| L | secondary winding of ignition transformer T | 64 henries |
| R | inherent (self) series resistance of L | $8 \times 10^3$ ohms |
| $e_{20}$ | open circuit voltage across L | varies as a function of time |
| k | coefficient of $i_1$ ($i_1$ defined in Table 2) | 1.62 amperes |
| K | coefficient of $e_{20}$ | $29 \times 10^3$ volts |
| a | attenuation coefficient of the exponential term of $e_{20}$ | $1.045 \times 10^2$ |
| $\beta$ | frequency in the phase term of $e_{20}$ | $2.73 \times 10^4$ radians/second |
| C | lumped or distributed parameter capacitor | 40 to 240 picofarads |

TABLE 2

| Symbolic Parameter | Definition |
|---|---|
| s | a complex number used to represent a Laplace transformed function from the time domain to the complex or frequency domain |
| $i_{10}$ | charging current of L1 as a function of time t |
| $i_1$ | primary winding current as a function of time t with secondary winding L open circuited |
| $I_{10}$ | the Laplace transform of $i_{10}$ |
| $I_1$ | the Laplace transform of $i_1$ |
| E | the Laplace transform of $e_{20}$ |
| $i_{2REF}$ | secondary winding current as a function of time t with no capacitor C in the secondary winding circuit |
| $I_{2REF}$ | the Laplace transform of $i_{2REF}$ |
| i | secondary winding current as a function of time t with capacitor C in the secondary winding circuit |
| I | the Laplace transform of i |
| v | secondary voltage feeding the igniter prior to current flow initiation in the igniter as a function of time t |
| $i_2$ | igniter firing current |
| t | the time domain variable, in seconds |
| $e_1$ | the induced voltage in L1 due to flow of current $i_1$ |

Referring to FIG. 7, the charge in primary winding L1 of ignition transformer T is obtained when timer switch Q is in its ON state, short circuiting the effect of C1 and charging primary L1 with current $i_{10}$, which when evaluated at time $t=10^{-3}$ seconds, representing the typical average charging time for the various ignition transformers feeding igniters of automotive systems, provides a full charge of L1. The Laplace transform for current $i_{10}$ is:

$$I_{10} = \frac{V}{L1s\left(s + \frac{R1}{L1}\right)} \quad (1)$$

which when evaluated by the Residue Theorem for the residues at the poles of (1) provides the equation for the charging current as a function of time. Hence, $$i_{10} = \frac{V}{R1}\left(1 - e^{-\frac{R1}{L1}t}\right) \quad (2)$$

and when evaluated at $t=10^{-3}$ seconds, $i_{10}=1.62$ amperes.

The primary winding current $i_1$ due to charge voltage $L1i_{10}$ is derived by solving the primary circuit equation including capacitance C1, with the secondary circuit of the ignition transformer in open circuit condition, achieved when switch Q is in its OFF state. The Laplace transform for $i_1$ becomes:

$$I_1 = \frac{ks}{(s + a \pm j\beta)} \quad (3)$$

and the solution of (3) in the time domain is:

$$i_1 = ke^{-at}\cos\beta t \quad (4).$$

Substituting the parameter values from Table 1 into (4):

$$i_1 = 1.62e^{-1.045\times 10^2 t}\cos 2.73\times 10^4 t \quad (5).$$

The voltage induced in the primary winding L1 is by Faraday's Law of Induction:

$$e_1 = -L1\frac{di_1}{dt}. \quad (6)$$

Solving (6):

$$e_1 = 296.31e^{-1.045\times 10^2 t}\sin 2.73\times 10^4 t \quad (7).$$

The voltage $e_{20}$ induced into secondary winding L is a function of the turns ratio of the ignition transformer multiplied by the induced primary voltage $e_1$. The turns ratio is:

$$n = \sqrt{\frac{L}{L1}} = \sqrt{\frac{64}{6.7\times 10^{-3}}} = 98. \quad (8)$$

Multiplying equation (7) by the solution for the turns ratio in (8), and using symbolic terms:

$$e_{20} = ne_1 = Ke^{-at}\sin\beta t \quad (9).$$

Substituting values from Table 1 and from (8):

$$e_{20} = 29\times 10^3 e^{-1.045\times 10^2 t}\sin 2.73\times 10^4 t \quad (10).$$

Figure 10:
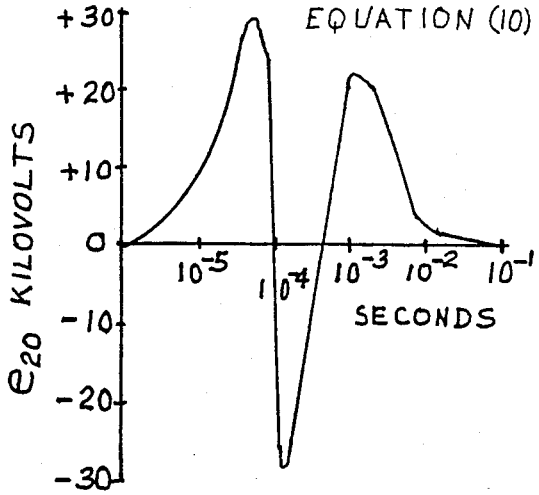
FIG. 10 is a graph showing the evaluated open circuit voltage response across the secondary winding of the ignition transformer as a function of time.

Equation (10) is represented by the graph of FIG. 10.

The Laplace transform of equation (9) in symbolic terms is:

$$E = \frac{K\beta}{(s + a \pm j\beta)}. \quad (11)$$

When substituting parameter values from Table 1, equation (11) becomes:

$$E = \frac{7.918\times 10^8}{(s + 1.045\times 10^2 \pm j\,2.73\times 10^4)}. \quad (12)$$

Equation (12) or in its sybolic form equation (11) will be used as the forcing voltage function upon the equivalent circuits of FIGS. 8 and 9, such equivalent circuits being used to write the Laplace transformed equations, the solution of which results in the loop current expressions for $i_{2REF}$ and i.

The Laplace transformed equation for reference current $i_{2REF}$ is:

$$I_{2REF} = \frac{E}{L\left(s + \frac{R}{L}\right)}. \quad (13)$$

Substituting the parametric values, equation (13) becomes:

$$I_{2REF} = \frac{12.37\times 10^6}{(s + 1.25\times 10^2)(s + 1.045\times 10^2 \pm j2.73\times 10^4)}. \quad (14)$$

Evaluating (14) by the Residue Theorem to obtain the inverse Laplace transform solution in the time domain:

$$i_{2REF} = 16.6\times 10^{-3}e^{-1.25\times 10^2 t} - 16.6\times 10^{-3}e^{-1.045\times 10^2 t}\cos 2.73\times 10^4 t. \quad (15)$$

Figure 11:
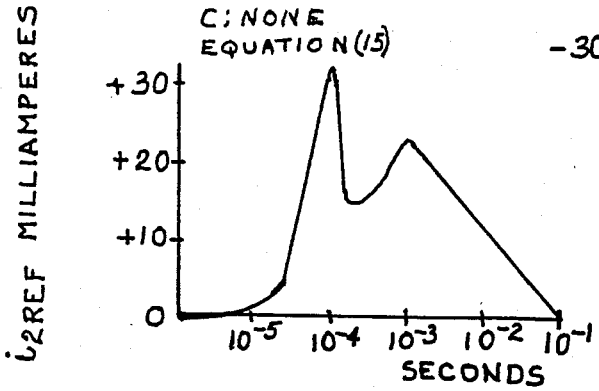
FIG. 11 is a graph showing the computed secondary winding reference current when no capacitive element is present in the secondary winding circuit, as a function of time.

Equation (15) is evaluated for various values of time and plotted in the graph of FIG. 11.

In writing the equation $i_{2REF}$ for igniter current flow when capacitive element C is not in the circuit of FIG. 8, the secondary winding circuit is substantially short circuited by one arc across gap G and another arc across the gap of igniter W, the arc resistance being less than one ohm and trivial compared to the inherent resistance R of $8\times 10^3$ ohms.

The peak current value of $i_{2REF}$ will be subsequently used as a normalizing factor when making current measurements with inductive pick up P, as shown in FIG. 1, on a relative current level basis for the same circuit with differently valued capacitive elements C and with no capacitive element, so that the peak current values with these different capacitive elements may be determined.

Referring to FIG. 9, and to provide a better understanding of Laplace transformation of integro-differential equations, the equation for loop current i in FIG. 9 is first written in conventional integro-differential form, as follows:

$$e_{20} = L\frac{di}{dt} + Ri + \frac{1}{C}\int i\,dt \quad (16)$$

where $e_{20}$ is the function as stated by equation (9) in symbolic form, and by equation (10) in parametric value form.

The Laplace transform of equation (16) is stated as:

$$E = \left(Ls + R + \frac{1}{Cs}\right) I \tag{17}$$

and when solved for I, equation (17) becomes:

$$I = \frac{E\,s}{L\left(s^2 + \frac{R}{L}s + \frac{1}{LC}\right)}. \tag{18}$$

Substituting the value of E from equation (10), we obtain:

$$I = \frac{\frac{K\beta}{L}s}{(s + a \pm j\beta)\left(s^2 + \frac{R}{L}s + \frac{1}{LC}\right)}. \tag{19}$$

Substituting the parameter values, except C, for the symbology, equation (19) becomes:

$$I = \frac{12.37 \times 10^6\,s}{(s + 1.045 \times 10^2 \pm j\,2.73 \times 10^4)} \times \left(s^2 + 1.25 \times 10^2 s + \frac{1.56 \times 10^{-2}}{C}\right) \tag{20}$$

Equation (20) is the general formula into which capacitive element values of 40 through 240 picofarads will be substituted for parameter C to first obtain loop currents i for each parameter value, and corresponding value of v in each case by utilizing Faraday's Law of Induction, v being shown graphed in FIGS. 12 through 17 in the solutions that follow.

Figure 12:
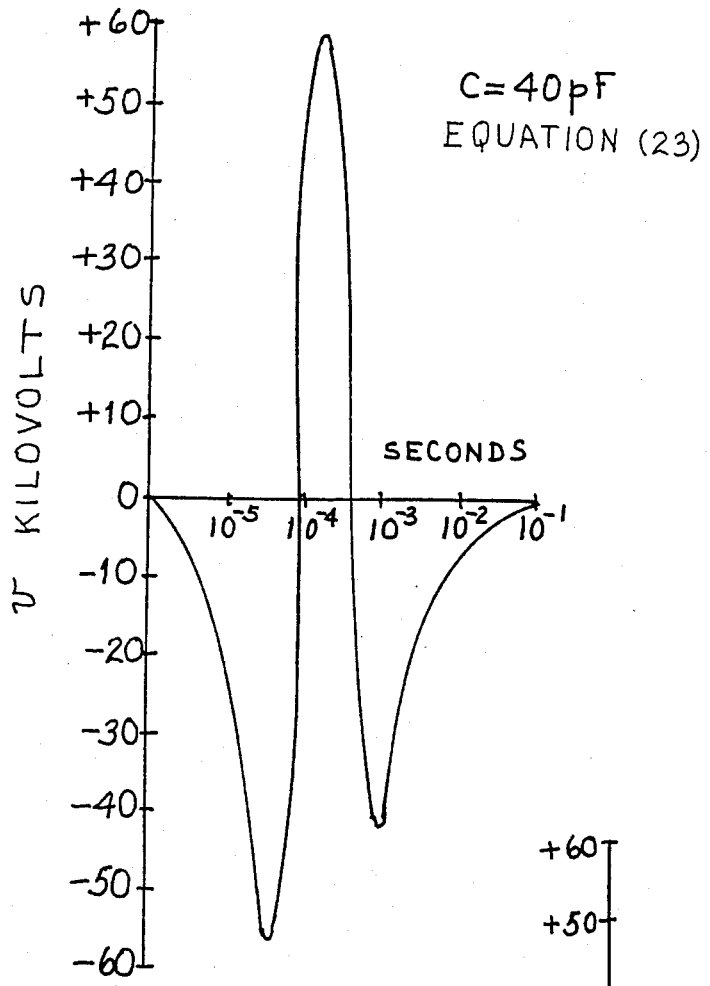
FIG. 12 is a graph showing the computed secondary winding voltage output response as a function of time in the presence of a 40 picofarad capacitive element in the secondary winding circuit.

The equation for the secondary winding current I in Laplace transform notation for C=40 picofarads substituted into equation (20), the equation for such current i in the time domain, and the equation for the voltage v induced in the secondary winding by virtue of current flow i just prior to initiation of igniter current $i_2$ is evaluated as shown in FIG. 12, are as follows:

$$I|_{C=40pF} = \frac{12.37 \times 10^6\,s}{(s + 1.045 \times 10^2 \pm j\,2.73 \times 10^4)} \times (s + .625 \times 10^2 \pm j\,1.98 \times 10^4) \tag{21}$$

$$i|_{C=40pF} = 35 \times 10^{-3}\,e^{-.625\times 10^2 t}\cos 1.98 \times 10^4 t - 35 \times 10^{-3}\,e^{-1.045 \times 10^2 t}\cos 2.73 \times 10^4 t \tag{22}$$

$$v|_{C=40pF} = 4.435 \times 10^3\,e^{-.625\times 10^2 t}\sin 1.98 \times 10^4 t - 61.152 \times 10^3\,e^{-1.045\times 10^2 t}\sin 2.73 \times 10^4 t \tag{23}$$

Figure 13:
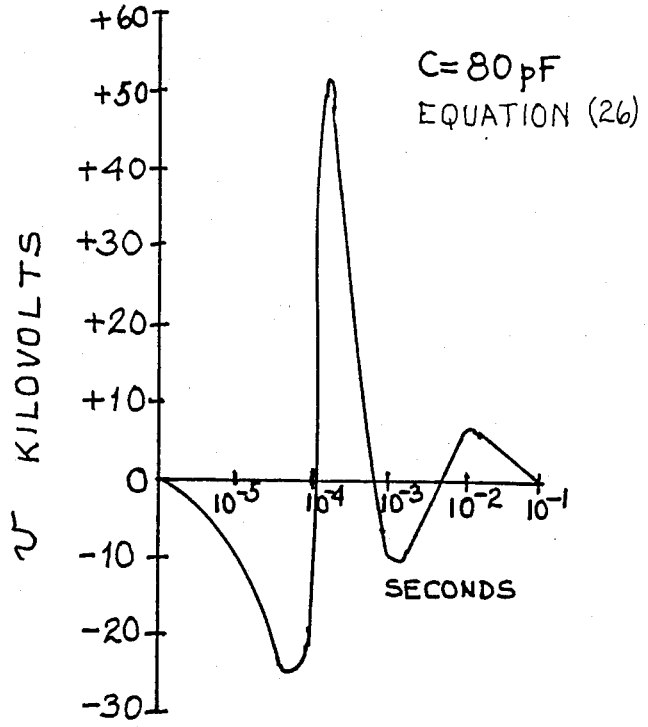
FIG. 13 is a graph showing the computed secondary winding voltage output response as a function of time in the presence of an 80 picofarad capacitive element in the secondary winding circuit.

For C=80 picofarads, v is evaluated as shown in FIG. 13.

$$I|_{C=80pF} = \frac{12.37 \times 10^6\,s}{(s + 1.045 \times 10^2 \pm j\,2.73 \times 10^4)} \times (s + .625 \times 10^2 \pm j\,1.397 \times 10^4) \tag{24}$$

$$i|_{C=80pF} = 22.5 \times 10^{-3}\,e^{-.625\times 10^2 t}\cos 1.397 \times 10^4 t - 22.5 \times 10^{-3}\,e^{-1.045\times 10^2 t}\cos 2.73 \times 10^4 t \tag{25}$$

-continued $$v|_{C=80pF} = 20.117 \times 10^3\,e^{-.625\times 10^2 t}\sin 1.397 \times 10^4 t - 39.312 \times 10^3\,e^{-1.045\times 10^2 t}\sin 2.73 \times 10^4 t \tag{26}$$

Figure 14:
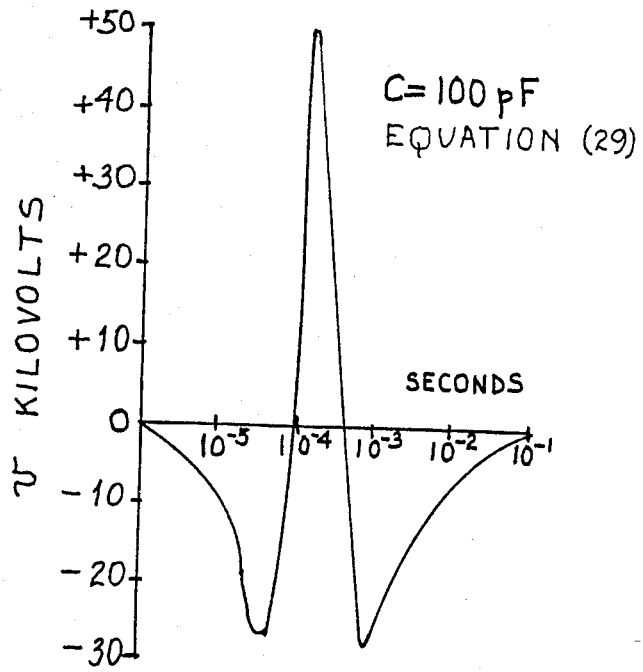
FIG. 14 is a graph showing the computed secondary winding voltage output response as a function of time in the presence of a 100 picofarad capacitive element in the secondary winding circuit.

For C=100 picofarads, v is evaluated as shown in FIG. 14.

$$I|_{C=100pF} = \frac{12.37 \times 10^6\,s}{(s + 1.045 \times 10^2 \pm j\,2.73 \times 10^4)} \times (s + .625 \times 10^2 \pm j\,1.25 \times 10^4) \tag{27}$$

$$i|_{C=100pF} = 21 \times 10^{-3}\,e^{-.625\times 10^2 t}\cos 1.25 \times 10^4 t - 21 \times 10^{-3}\,e^{-1.045\times 10^2 t}\cos 2.73 \times 10^4 t \tag{28}$$

$$v|_{C=100pF} = 16.80 \times 10^3\,e^{-.625\times 10^2 t}\sin 1.25 \times 10^4 t - 36.691 \times 10^3\,e^{-1.045\times 10^2 t}\sin 2.73 \times 10^4 t \tag{29}$$

Figure 15:
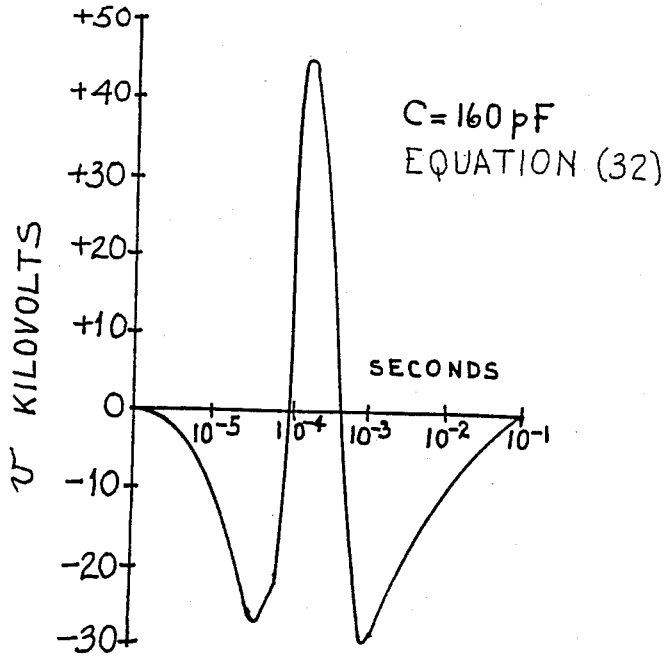
FIG. 15 is a graph showing the computed secondary winding voltage output response as a function of time in the presence of a 160 picofarad capacitive element in the secondary winding circuit.

For C=160 picofarads, v is evaluated as shown in FIG. 15.

$$I|_{C=160pF} = \frac{12.37 \times 10^6\,s}{(s + 1.045 \times 10^2 \pm j\,2.73 \times 10^4)} \times (s + .625 \times 10^2 \pm j\,9.88 \times 10^3) \tag{30}$$

$$i|_{C=160pF} = 19.1 \times 10^{-3}\,e^{-.625\times 10^2 t}\cos 9.88 \times 10^3 t - 19.1 \times 10^{-3}\,e^{-1.045\times 10^2 t}\cos 2.73 \times 10^4 t \tag{31}$$

$$v|_{C=160pF} = 12.077 \times 10^3\,e^{-.625\times 10^2 t}\sin 9.88 \times 10^3 t - 33.372 \times 10^3\,e^{-1.045\times 10^2 t}\sin 2.73 \times 10^4 t \tag{32}$$

Figure 16:
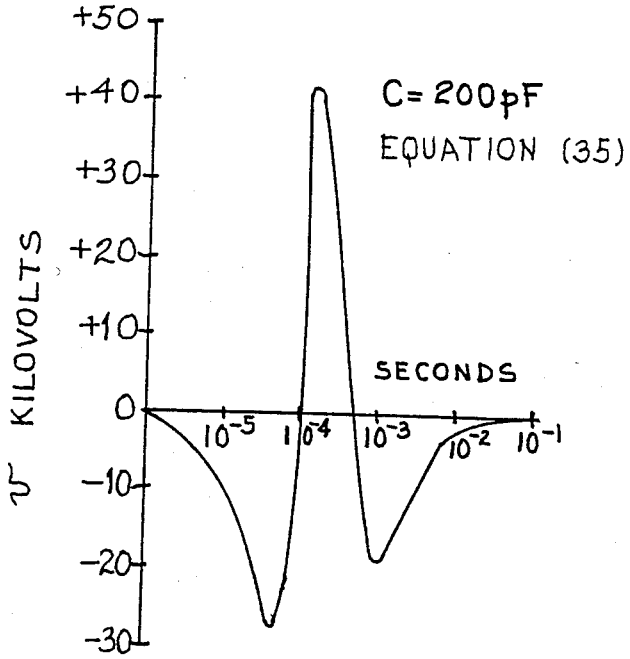
FIG. 16 is a graph showing the computed secondary winding voltage output response as a function of time in the presence of a 200 picofarad capacitive element in the secondary winding circuit.

For C=200 picofarads, v is evaluated as shown in FIG. 16.

$$I|_{C=200pF} = \frac{12.37 \times 10^6\,s}{(s + 1.045 \times 10^2 \pm j\,2.73 \times 10^4)} \times (s + .625 \times 10^2 \pm j\,8.83 \times 10^3) \tag{33}$$

$$i|_{C=200pF} = 18.5 \times 10^{-3}\,e^{-.625\times 10^2 t}\cos 8.83 \times 10^3 t - 18.5 \times 10^{-3}\,e^{-1.045\times 10^2 t}\cos 2.73 \times 10^4 t \tag{34}$$

$$v|_{C=200pF} = 10.455 \times 10^3\,e^{-.625\times 10^2 t}\sin 8.83 \times 10^3 t - 32.323 \times 10^3\,e^{-1.045\times 10^2 t}\sin 2.73 \times 10^4 t \tag{35}$$

Figure 17:
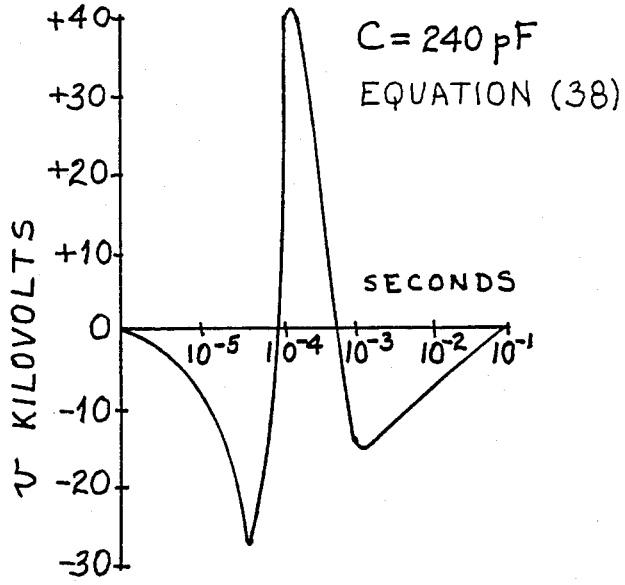
FIG. 17 is a graph showing the computed secondary winding voltage output response as a function of time in the presence of a 240 picofarad capacitive element in the secondary winding circuit.

For C=240 picofarads, v is evaluated as shown in FIG. 17.

$$I|_{C=240pF} = \frac{12.37 \times 10^6\,s}{(s + 1.045 \times 10^2 \pm j\,2.73 \times 10^4)} \times (s + .625 \times 10^2 \pm j\,8.06 \times 10^3) \tag{36}$$

$$i|_{C=240pF} = 18.2 \times 10^{-3}\,e^{-.625\times 10^2 t}\cos 8.06 \times 10^3 t - 18.2 \times 10^{-3}\,e^{-1.045\times 10^2 t}\cos 2.73 \times 10^4 t \tag{37}$$

$$v|_{C=240pF} = 9.388 \times 10^3\,e^{-.625\times 10^2 t}\sin 8.06 \times 10^3 t - 31.799 \times 10^3\,e^{-1.045\times 10^2 t}\sin 2.73 \times 10^4 t \tag{38}$$

The voltage v induced in the secondary winding prior to igniter firing is of interest since it will be the means by which a long igniter arc can be initiated, such arc being defined by current $i_2$ through the igniter. Additionally, the igniter current $i_{2REF}$, when no capacitor is present in the secondary winding circuit, is required to enable relative current measurements with different values of capacitor elements to establish actual igniter current levels.

The circulating current i in itself is of no interest except in terms of being able to derive the voltages v therefrom by differentiating such expressions for current and multiplying the derivative by the inductance value of the secondary winding, in accordance with Faraday's Law of Induction.

Figure 18:
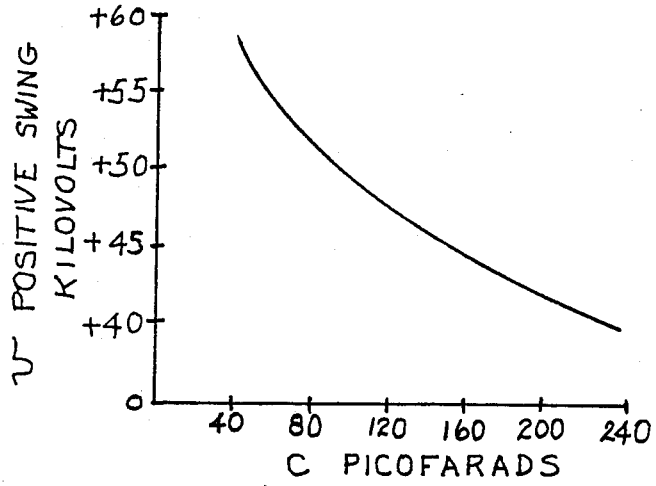
FIG. 18 is a graph of the positive secondary voltage swings versus capacitive element values.

Referring to FIG. 18, the positive peak values of each of the voltages v as defined by their characteristics shown in FIGS. 12 through 17, are plotted as a function of capacitive element C. Such graphs illustrate exponential type curves where the smallest value capacitor gives rise to the largest voltage magnitude, and the largest value capacitor gives rise to the lowest voltage magnitude.

It is now necessary to determine the actual igniter firing current $i_2$. It is not practical to calculate such firing current since such current is a function of variable resistances comprising gap G and the gap of igniter W, which would have to be included in the calculations, but which are not known. Such variable resistances did not have to be included in the calculation of $i_{2REF}$ since these were in series with the secondary winding and the self resistance of such winding swamped such variable resistances.

Hence, a method of combining a calculated value of $i_{2REF}$ current for the situation when no capacitor is present in the secondary circuit, with a factor relating to a relative current flow is used to establish the actual current flow in the igniter. Such results are shown in Tables 3, 4, and 5, wherein Table 3 provides an approximate calculation, but Tables 4 and 5 provide more accurate results by the measurement techniques.

TABLE 3

| $i_2$ Calculation of Approximate Firing Current | | | |
|---|---|---|---|
| C picofarads | Reactance of C in Ohms at $2.73 \times 10^4$ radians second | Peak of Positive Voltage Excursion of v | $i_2$ milliamperes |
| 40 | $.916 \times 10^6$ | $58.7 \times 10^3$ | 64.08 |
| 60 | $.61 \times 10^6$ | $55 \times 10^3$ | 90.16 |
| 140 | $.26 \times 10^6$ | $45.5 \times 10^3$ | 175.00 |
| 160 | $.23 \times 10^6$ | $44.6 \times 10^3$ | 193.91 |
| 200 | $.18 \times 10^6$ | $42.06 \times 10^3$ | 233.67 |
| 240 | $.15 \times 10^6$ | $40.36 \times 10^3$ | 269.07 |

TABLE 4

| $i_2$ Measurement of Firing Current with VTVM | | | | |
|---|---|---|---|---|
| C pico-farads | Units of Meter Deflection | Units With C Units Without C | Peak $i_{2REF}$ milliamperes | $i_2$ milliam-peres |
| None | 1.75 | 1.0 | 31.45 | 31.45 |
| 40 | 3.30 | 1.9 | 31.45 | 59.76 |
| 60 | 5.30 | 3.03 | 31.45 | 95.25 |
| 140 | 9.0 | 5.14 | 31.45 | 161.74 |
| 160 | 11.0 | 6.29 | 31.45 | 197.69 |
| 200 | 13.0 | 7.43 | 31.45 | 233.63 |
| 240 | 15.6 | 8.91 | 31.45 | 280.40 |

TABLE 5

| $i_2$ Measurement of Firing Current with Oscilloscope | | | |
|---|---|---|---|
| C picofarads | Units of Vertical Beam Deflection | Peak $i_{2REF}$ milliamperes | $i_2$ milliamperes |
| None | 1.0 | 31.45 | 31.45 |

TABLE 5-continued

| $i_2$ Measurement of Firing Current with Oscilloscope | | | |
|---|---|---|---|
| C picofarads | Units of Vertical Beam Deflection | Peak $i_{2REF}$ milliamperes | $i_2$ milliamperes |
| 40 | 1.6 | 31.45 | 50.30 |
| 60 | 2.0 | 31.45 | 62.90 |
| 160 | 5.5 | 31.45 | 173.00 |
| 200 | 7.0 | 31.45 | 220.00 |
| 240 | 8.7 | 31.45 | 274.00 |

Figure 19:
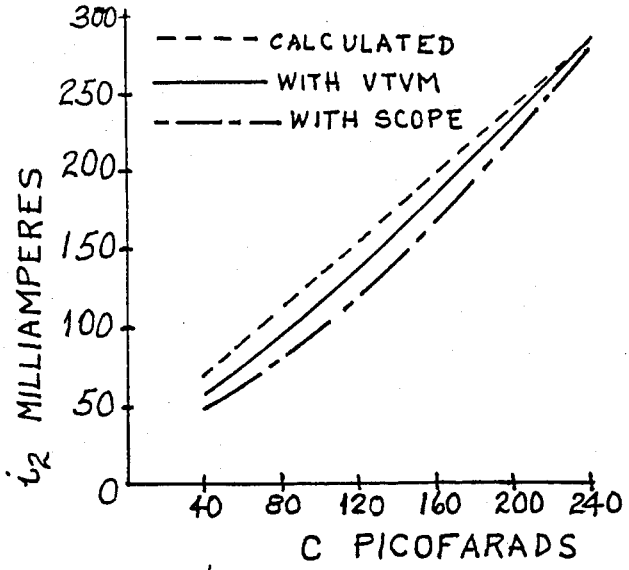
FIG. 19 is a graph showing igniter current level as a function of capacitive element values obtained by calculation, by vacuum tube voltmeter and by oscilloscope measurements.

Referring to FIG. 19 and to Tables 3, 4 and 5, the igniter firing current $i_2$ characteristics as a function of the several capacitive elements of C are utilized in the circuit of FIG. 9, displaying three generally exponential type curves, one for each of the data in the tables. Table 3 provides approximate firing current values by using the positive peak voltage levels graphed in FIG. 18, and dividing such voltage levels by the reactances of each capacitive element at the dominant frequency of $2.73 \times 10^4$ radians per second.

Table 4 provides the results when a vacuum tube voltmeter (VTVM) is instrumented as shown in FIG. 1, and relative units of meter deflection are established for each capacitive element used as well as a relative number of of units of meter deflection being established for the situation when no capacitive element is used. The relative unit meter deflection for each capacitor used is divided by the relative meter deflection obtained when no capacitor is used, and such ratio is used to multiply $i_{2REF}$ current of 31.45 milliamperes, the peak current level computed for no capacitor in the secondary winding circuit, to obtain the actual current $i_2$ for each capacitive element.

Table 5 provides the results when the vertical input terminals of an oscilloscope are connected to the pickup P as shown in FIG. 1, with similar procedures as outlined above in conjunction with Table 4 procedure, to obtain the actual current $i_2$ for each capacitive element. However, a vacuum tube voltmeter provides a more reliable and repeatable measurement. In this situation, the frequency response of the ignition system circuit is well within the response of almost any vacuum tube voltmeter, the highest frequency encountered being $2.73 \times 10^4$ radians per second, so that a vacuum tube voltmeter is ideal for measuring signal amplitudes.

For each of the three methods used to arrive at the actual igniter firing current value, the curves of FIG. 19 show that that such current is at its lowest level when the smallest value of capacitor was used, and at its largest value when the largest value of capacitor was used.

The capacitor value cannot be indiscriminantly increased, inasmuch as the maximum capacity value is directly related to the collector current rating of switch Q. This situation was verified by increasing the capacitance to a value that would drive $i_2$ to over 400 milliamperes. The transistor Q being a type 2N6287 having a peak collector current rating of 40 amperes, as expected, such transistor burned out after several seconds of operation due to exceeding the rated collector current rating. Therefore, if more than 400 milliamperes of igniter current is desired, transistors are available with collector current ratings of over 100 amperes.

On the low side of the capacitive element range, decreasing the capacitive element below 40 picofarads would also decrease the igniter current, but more importantly, a too low capacitive value would create a voltage level v of such large magnitude that would create excessive arcing external to the igniter. In any event there is a limit to the level of high voltage needed. Such limit is to insure igniter firing under engine cylinder pressures with igniters having structures that provide the longest arcs desired.

Referring to Tables 3, 4 and 5, it can be seen that by utilizing a capacitor C, the secondary voltage v can be increased. It follows that if a given secondary voltage produced by an ignition transformer is adequate, then capacitor C can be used as a comparator for a reduced number of secondary winding turns yet obtaining the same voltage output or the same effective turns ratio as the actual turns ratio before reduction in the winding turns. One example will suffice to illustrate this point. If a 40 picofarad capacitor were to be used, the voltage produced prior to reduction in the number of turns would approximately double. That is an increase from 29 kilovolts, as shown in FIG. 10, to more than 58 kilovolts, as also shown in FIG. 12. It can then be seen that about one-half the number of secondary winding turns can be decreased in the ignition transformer utilizing the 40 picofarad capacitor across the secondary winding. Realizing that in the average ignition transformer the turns ratio of:

$$98 = \frac{26920 \text{ secondary winding turns}}{275 \text{ primary winding turns}},$$

an ignition transormer with 13,460 secondary winding turns may be used when a 40 picofarad capacitor is in the system with the same effect as far as voltage is concerned as the 26,920 secondary winding turns without the 40 picofarad capacitor in the system. It is obvious that not only is the transformer smaller and has lower internal copper losses, but is materially less expensive to fabricate.

An additional benefit is also derived in terms of ignition current increase. Since the primary ampere-turns must equal the secondary ampere-turns, less some losses, the reduction to half the number of secondary winding turns would double the firing current. With a 40 picofarad capacitor shunting the secondary winding, instead of $i_2$ being about 60 milliamperes, such current will be in order of 120 milliamperes.

Although the foregoing discussion made reference to an ignition transformer, it should be obvious that the use of capacitor C would be applicable to any other transformer.

I claim:

1. An ignition transformer having a secondary winding, characterized by:

a distributed capacity component having first and second ends, said component constituting a pair of electrical insulation-clad transposed wires comprising first and second wires, said first wire being coupled to the secondary winding at the first end and being unterminated at the second end, said second wire being coupled to the secondary winding at the second end and being unterminated at the first end, said electrical insulation constituting dielectric material for said distributed capacity component.

2. The transformer as stated in claim 1, wherein said component increases the output voltage level of the secondary winding inversely with the parameter value of said component.

3. The transformer as stated in claim 1, wherein said component increases the output current from said secondary winding, as compared to the absence of said component from said transformer.

4. The transformer as stated in claim 1, wherein said component is shunt-connected to the secondary winding.

5. The transformer as stated in claim 1, including a primary winding coupled to the secondary winding, said component being connected between the secondary and primary windings.

6. The transformer as stated in claim 1, including a power source, and a primary winding coupled to the secondary winding, said power source being intermittently coupled to the primary winding, said component being connected between the secondary winding and power source.

7. The transformer as stated in claim 1, wherein said component increases the current output level from the secondary winding, and wherein the increased current output level varies directly with the parameter value of said component.

8. An ignition transformer having a secondary winding, characterized by:

a distributed capacity component having first and second ends, said component comprising a dielectric body, an electrode partially embedded in and partially exposed from said body, the partially exposed electrode being coupled to the secondary winding at the first end and the embedded part of the electrode being unterminated, a coil of wire wound on said body, said coil being coupled to the secondary winding at the second end and being unterminated at the first end.

9. The transformer as stated in claim 8, wherein said component increases the output voltage from the secondary winding inversely with the parameter value of said component.

10. The transformer as stated in claim 8, wherein said component increases the output current from the secondary winding, as compared with the output current of the secondary winding in the absence of said component.

11. The transformer as stated in claim 8, wherein said component is shunt-connected to the secondary winding.

12. The transformer as stated in claim 8, including a primary winding coupled to the secondary winding, said component being connected between the secondary and primary windings.

13. The transformer as stated in claim 8, including a power source, and a primary winding coupled to the secondary winding, said power source beng intermittently coupled to the primary winding, said component being connected between the secondary winding and power source.

14. The transformer as stated in claim 8, wherein said component increases the current output level from the secondary winding, and wherein the increased current output level varies directly with the parameter value of said component.

15. An ignition transformer having a secondary winding, characterized by:

a transposed pair of electrically insulated wires, said pair having first and second ends, said pair constituting first and second wires, the first wire being coupled to the secondary winding at the first end and being unterminated at the second end, the second wire being coupled to the secondary winding at the second end and being unterminated at the first end.

16. The transformer as stated in claim 15, wherein said pair increases the output voltage level of the secondary winding as compared to the secondary voltage level in the absence of said pair.

17. The transformer as stated in claim 15, wherein said pair increases the output current level of the secondary winding as compared to the secondary current level in the absence of said pair.

18. The transformer as stated in claim 15, wherein said pair is shunt-connected to the secondary winding.

19. The transformer as stated in claim 15, including a primary winding coupled to the secondary winding, said pair being connected between the secondary and primary windings.

20. The transformer as stated in claim 15, including a power source, and a primary winding coupled to the secondary winding, said power source being intermittently coupled to the primary winding, said pair being connected between the secondary winding and power source.

21. An ignition transformer having a secondary winding, characterized by:

a distributed capacity component having first and second ends, said component having a pair of electrically conductive members and dielectric material separating said members, said dielectric material and conductive members extending between said first and second ends, said component exhibiting capacity generally uniformly distributed along said component between said ends, one of said members being coupled to the secondary winding at the first end and being unterminated at the second end, the other of said members being coupled to the secondary winding at the second end and being unterminated at the first end.

22. The transformer as stated in claim 21, wherein said component increases the output voltage level of the secondary winding inversely with the capacitive value of said component.

23. The transformer as stated in claim 21, wherein said component increases the output current of said secondary winding, as compared with the output current in the absence of said component from the transformer.

24. The transformer as stated in claim 21, wherein said component is shunt-connected to the secondary winding.

25. The transformer as stated in claim 21, including a primary winding coupled to the secondary winding, said component being connected between the secondary and primary windings.

26. The transformer as stated in claim 21, including a power source, and a primary winding coupled to the secondary winding, said power source being intermittently coupled to the primary winding, said component being connected between the secondary winding and power source.

27. The transformer as stated in claim 21, wherein said component increases the current output level of the secondary winding, and wherein the increased current output level varies directly with the capacitive value of said component.

* * * * *